United States Patent [19]

Stevens

[11] 3,993,987

[45] Nov. 23, 1976

[54] LOCKING DEVICE HAVING AN INTEGRAL ALARM SYSTEM

[76] Inventor: Edward C. Stevens, 4744 N. Larkin, Milwaukee, Wis. 53211

[22] Filed: Mar. 3, 1975

[21] Appl. No.: 554,964

[52] U.S. Cl. ..... 340/274 R; 70/49; 200/61.64; 340/283

[51] Int. Cl.[2] ..... E05B 45/08

[58] Field of Search ..... 340/283, 280, 274 R, 340/274 C, 63; 70/1, 35, 49, 416, 439; 200/61.67, 61.64, DIG. 12

[56] References Cited

UNITED STATES PATENTS

| | | | |
|---|---|---|---|
| 181,078 | 8/1976 | Larned | 200/DIG. 12 |
| 3,755,778 | 8/1973 | Kennedy et al. | 340/280 |
| 3,810,145 | 5/1974 | Gusaras | 200/61.67 |
| 3,824,540 | 7/1974 | Smith | 340/280 |
| 3,879,721 | 4/1975 | Yereance | 340/283 |

*Primary Examiner*—Glen R. Swann III

*Attorney, Agent, or Firm*—Andrus, Sceales, Starke & Sawall

[57] ABSTRACT

A padlock includes a body and one or both ends of a shackle can be locked within the body by a lock bolt operated by a locking mechanism, such as a key-operated tumbler. The shackle contains an internal electrically conductive element which is connected in an electrical circuit with a battery and an alarm, both of which are located within the lock body. In addition, a series of insulated wires can be positioned along the inner wall of the body and are also connected in an electrical circuit. If the shackle or lock body is cut, or if the shackle is pried or separated from the lock body, the electrical circuit will be closed to actuate the alarm. The circuit is arranged so that either no power or minimum power is drawn from the battery unless the security of the padlock is violated.

12 Claims, 5 Drawing Figures

Fig. 1
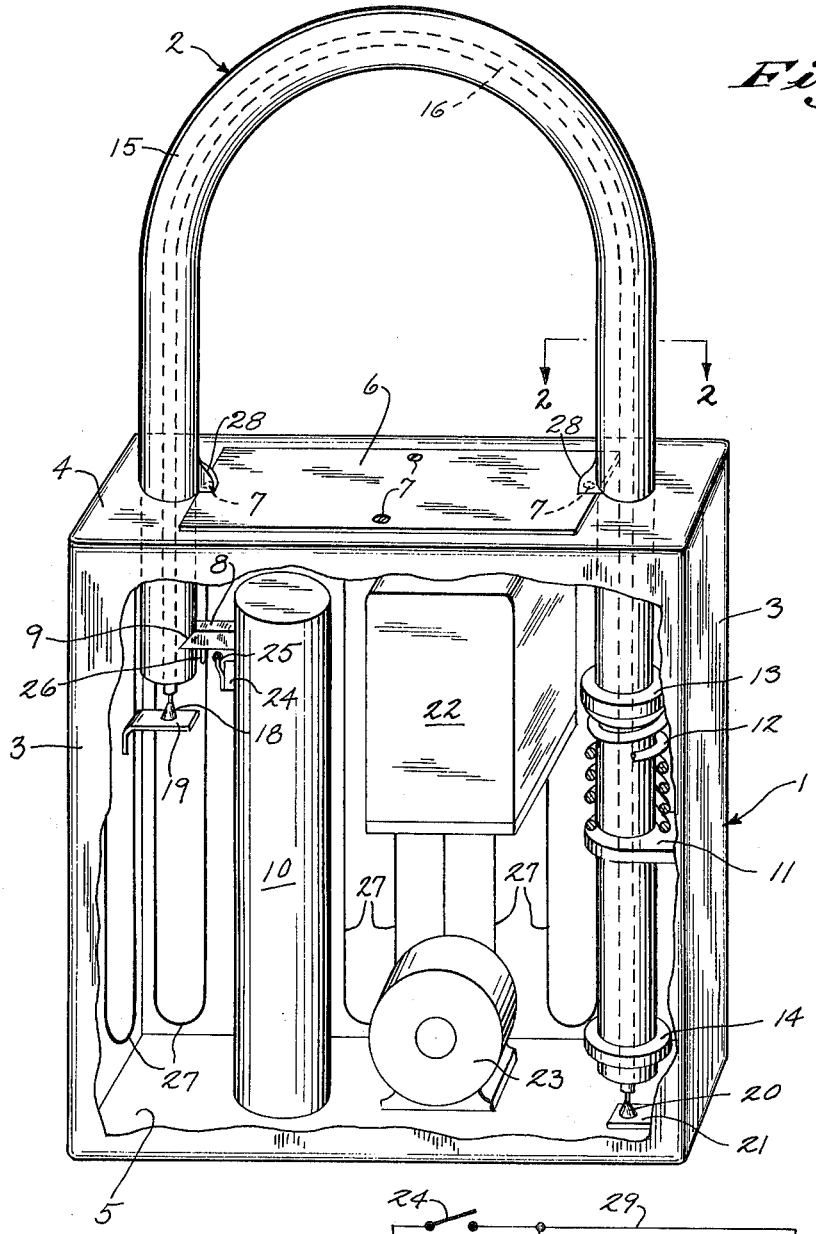
Fig. 2
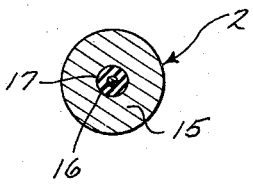
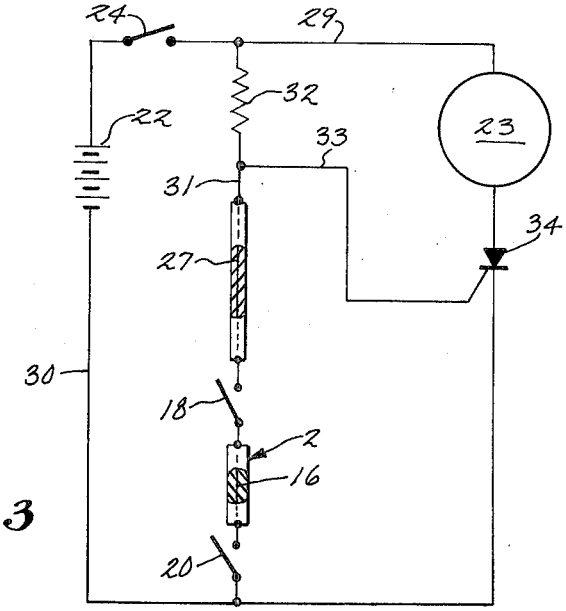
Fig. 3

Fig.4
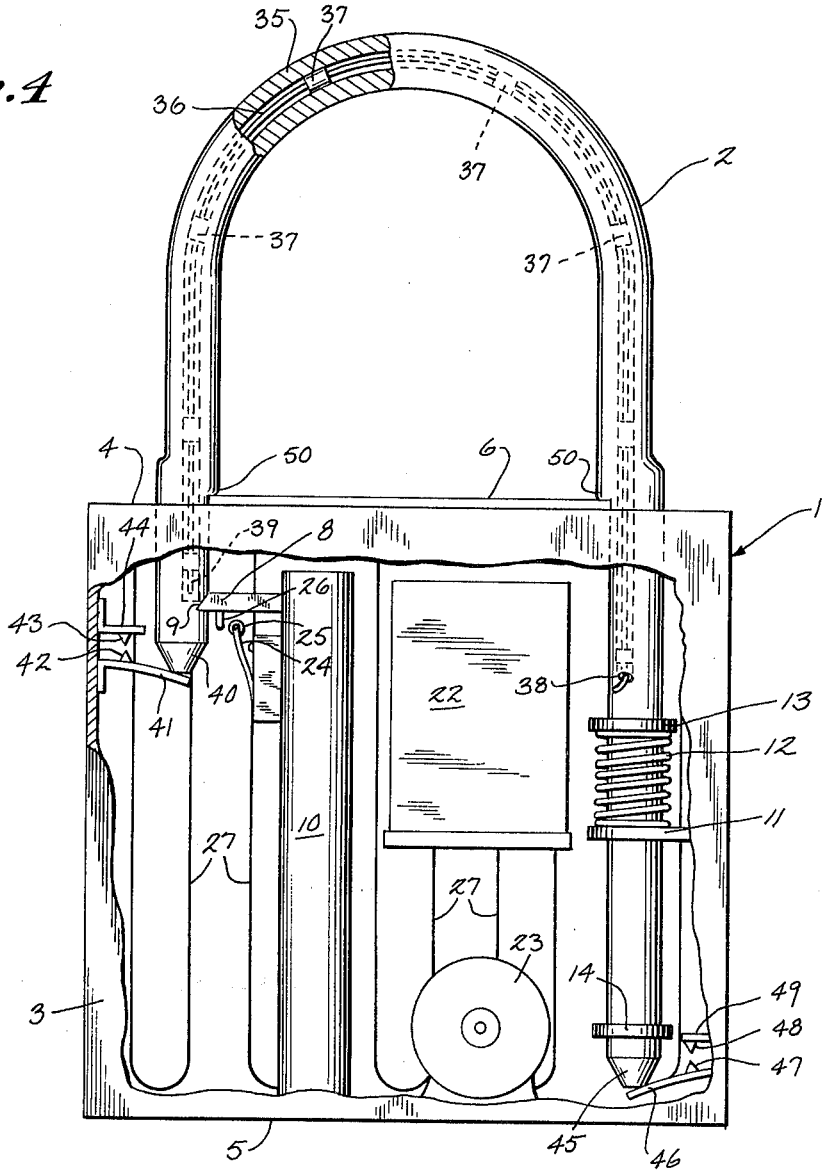
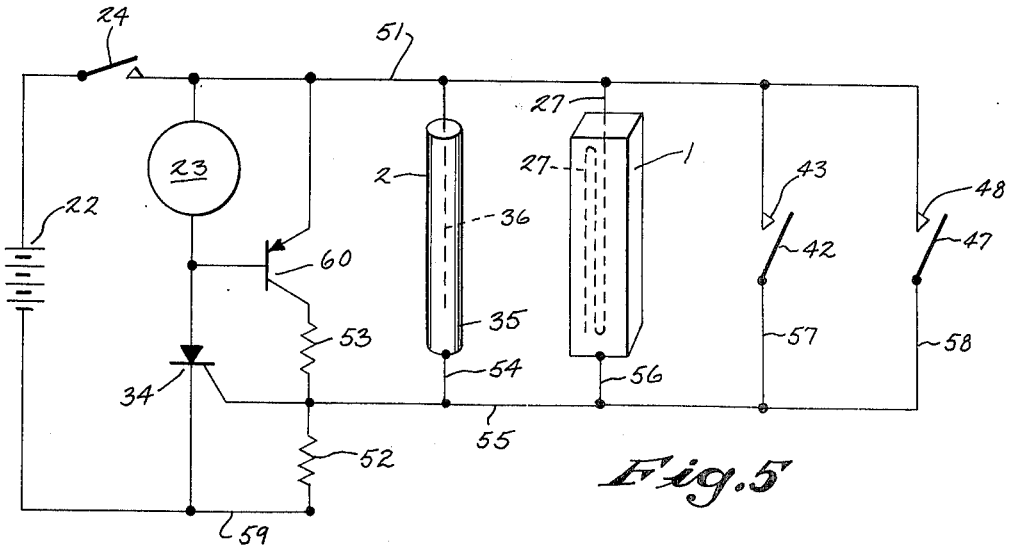
Fig.5

LOCKING DEVICE HAVING AN INTEGRAL ALARM SYSTEM

BACKGROUND OF THE INVENTION

Locking devices having either a rigid-type shackle or a flexible shackle, such as a chain or cable, are occasionally violated by forcing open the lock or by either cutting the shackle or the lock body. In order to alert persons within the vicinity to the fact that the security of the locking device is violated, alarms, such as a horn, have been associated in the past with the locking device. Devices of this type, as used in the past, were not particularly satisfactory in that the alarm systems, in general, were designed so that the power of the battery was used continuously, with the result that the battery had a short life and the alarm system was only operable for relatively short periods of time. In addition, devices of this type, as used in the past, normally did not include a test feature in which the unit could be tested to determine whether the battery was still operable. As a further disadvantage, the prior art locking devices having alarm features would only operate the alarm if the shackle was severed, and the alarm would not be actuated if the security of the device was violated by either cutting the lock or by prying the shackle out of the body.

SUMMARY OF THE INVENTION

The invention relates to a locking device, such as a padlock, having an integral alarm system. In accordance with the invention, the padlock includes a body and a shackle which is adapted to be connected to the object to be secured. The shackle has at least one end that is removable from the body and can be locked within the body by a lock bolt. The lock bolt is moved between a locked and a released position by manually operated locking mechanism, such as a key-operated tumbler.

The shackle is formed with an outer metal sheath and contains an inner electrically conductive element which is insulated from the sheath. The conducting element is connected in an electrical circuit with a battery and an alarm, such as a horn, both of which are located within the lock body. In addition, a second series of electrically conductive elements, such as insulated wires, can be positioned along the inner wall of the lock body and are connected in the electrical circuit.

If the shackle or the lock body is cut, the alarm will be actuated to alert persons in the vicinity to the fact that the security of the padlock has been violated.

When the shackle is in the locked position, the ends of the elctrical conductive element contained within the shackle are biased into engagement with contacts connected in the electrical circuit. If the shackle is pried out of, or otherwise separated from the lock body without using the padlock key, the circuit will actuate the alarm.

Thus, with the alarm system of the invention, the alarm will be actuated if the security of the padlock is violated by either cutting the shackle, cutting the lock body, or prying the shackle from the body without using the padlock key.

As a further and important feature of the invention, the electrical circuit is arranged so that minimum power or no power will be drawn from the battery unless the security of the padlock is violated. This enables the alarm system to be in an operable condition for extended periods of time.

The alarm system also includes a provision which will disconnect the battery from the alarm when the tumbler key moves the lock bolt to the release position. This will insure that the alarm will not be actuated when the shackle is removed from the lock body after release of the lock bolt during normal operation of the padlock. However, positioning the key to the locked position with the shackle removed from the lock body will turn the alarm circuit on, to thereby provide a test procedure to determine whether the alarm system is operable.

Other objects and advantages will appear in the course of the following description.

DESCRIPTION OF THE DRAWINGS

The drawings illustrate the best mode presently contemplated of carrying out the invention.

FIG. 1 is a perspective view of a typical padlock with parts broken away in section showing the invention;

FIG. 2 is a section taken along line 2—2 of FIG. 1;

FIG. 3 is a circuit diagram of the locking device of FIG. 1;

FIG. 4 is a side elevation with parts broken away of a modified form of the invention; and FIG. 5 is a circuit diagram of the locking device of FIG. 4.

DESCRIPTION OF THE PREFERRED EMBODIMENT

The drawings illustrate the invention as applied to a typical padlock which includes a lock body 1 and a shackle 2 which is adapted to be connected to an article that is to be secured. The shackle 2, as illustrated, is a rigid U-shaped member, but it is contemplated that the shackle can also take the form of a flexible member, such as a cable or chain. Thus, the term "shackle" as used in the description and claims is intended to include a rigid type shackle, as illustrated in the drawings, as well as a flexible type of shackle.

The lock body 1 includes side walls 3 which are connected at their upper edges by a top wall 4 and at their bottom edges by a bottom wall 5. The top wall 4 is provided with an access opening which is normally enclosed by a plate 6 that is connected to the top wall by a series of screws 7 or other fasteners.

The short end of the shackle 2 is locked within the body 1 by a lock bolt 8 which engages a notch 9 formed in the shackle end. The lock bolt 8 is moved between a locked position and a released position through a standard key operated tumbler mechanism, indicated generally by 10. The lower end of the tumbler mechanism is exposed through the bottom wall 5 and is adapted to receive a key, not shown, which when turned, will move the lock bolt 8 between the locked and released position. It is contemplated that other locking mechanisms can be used in place of the key operated tumbler mechanism, such as a combination locking mechanism or a warded locking mechanism, which uses a key but not tumblers.

The long end of the shackle 2 is mounted for pivoting movement within the casing through a collar 11, which receives the shackle end. To urge the shackle outwardly, when the lock bolt 8 is released, a coil spring 12 is positioned between the collar 11 and a collar 13 formed on the shackle end. The force of the spring acting against the collar 13 will urge the shackle outwardly when the lock bolt 8 is released.

To prevent the shackle from being displaced from the lock body a retaining collar or stop 14 is located on the lower portion of the shackle end and is adapted to engage the collar 11 to prevent complete displacement of the shackle from the lock body.

As illustrated in FIG. 2, the shackle 2 is provided with an outer metal sheath 15 which contains an electrically conductive element, such as a wire 16, that is insulated from the sheath by a layer of insulating material 17. The wire 16 extends continuously through the shackle 2 and the ends of the wire 16 project outwardly of the respective ends of the shackle. The end of the wire 16 that projects from the short end of the shackle is adapted to engage an electrical contact 18 which is supported by an insulated spring support 19 attached to the side wall 3 of the lock body. The support 19 is designed to urge the contact 18 upwardly and thereby insure a positive electrical engagement between the contact 18 and the end of the wire 16 when the shackle is locked within the lock body. Similarly, the projecting end of the wire 16 which extends beyond the long end of the shackle is adapted to engage a contact 20 mounted on an insulting spring support 21, similar to support 19. The support 21 urges the contact 20 upwardly into positive engagement with the projecting end of the wire 16.

The contacts 18 and 20 are connected in an electrical circuit, as will be described in greater detail hereinafter, with a battery 22 and an alarm 23, such as a horn both of which are mounted within the lock body.

An "on-off" switch is incorporated in the electrical circuit to disconnect the circuit when the lock bolt 8 is moved to the released position. This will insure that the alarm will not be actuated when the shackle is removed from the lock body under normal operation of the padlock. The "on-off" switch unit comprises a switch 24 mounted on the tumbler mechanism 10 and the arm 25 of the switch is adapted to be engaged by a projection 26 on the lock bolt 8 when the lock bolt is moved to the released position.

In order to prevent violation of the security of the padlock by cutting the lock body, an electrically conductive element, such as an insulated wire 27, is attached to the inner wall of the side wall 3 and is connected in the electrical circuit. The wire 27 is normally applied in a series of loops or convolutions which are approximately one-half inch apart.

To prevent access plate 6 from being removed when the shackle is in the locked position and thereby prevent an intruder from removing the battery 22, the shackle arms are provided with projections or ears 28 which are adapted to engage the upper surface of the plate 6 when the shackle is in the locked position, and preferably the ears 28 are located above the screws 7 so that the screws cannot be removed when the shackle is in the locked position. Engagement of the ears 28 with the plate 6 will prevent the plate 6 from being removed, and will thereby prevent the battery from being removed from the lock body 1 when the shackle is in the locked position. While the drawings show the shackle arms having distinct projections or ears 28, it is contemplated that the shackle arms can be milled or bent to provide similar projecting ledges or shoulders which will engage the upper surface of plate 6 when the shackle is locked.

The electrical circuit for the alarm system is illustrated in FIG. 3. As shown in the wiring diagram, the battery 22 is connected to the alarm or horn 23 by lines 29 and 30. The on-off switch 24 is connected in line 29 and when the switch is opened by movement of the lock bolt to the released position, the circuit will be open so that the horn 23 cannot be actuated.

Line 31 is connected across the horn, and a resistor 32 as well as the electrical wire 27, contacts 18 and 20, and the shackle wire 16 are connected in series in line 31. Line 33 connects the line 31 with a silicon controlled rectifier (SCR) 34.

Operating the key in the tumbler mechanism 10 will cause the lock bolt 8 to engage the notch 9 in the shackle, and this action also closes the switch 24 which applies power to the alarm circuit. As the negative side of the battery is connected to the gate terminal of the SCR, the SCR will under these conditions be turned off and no power will be applied to the alarm. However if the wire 16 is severed, or if the wire 27 is cut, or if the contacts 18 or 20 are opened by prying the shackle outwardly, the connection of the gate lead of the SCR to the negative side of the battery will be broken with the result that the SCR turns on and the alarm 23 will be energized. Therefore, with the alarm system of the invention, the alarm will be actuated by either cutting the shackle 2, prying or otherwise removing either end of the shackle from the lock body, or cutting the continuous conductor 27 attached to the inside of the lock body.

With the circuitry as illustrated, minimum poWer will be drained from the batter unless the SCR is turned on by one of the above conditions, thereby substantially increasing the life of service of the alarm system.

The key operated switch 24 will disconnect the alarm system whenever the lock bolt 8 is moved to the released position, thereby preventing the alarm from being actuated when the shackle is removed from the lock body under normal operating conditions.

The alarm system also has an additional feature that enables the alarm to be tested prior to closing the lock. If the tumbler mechanism 10 is operated to move the lock bolt to the locked position, while the short end of the shackle is outside of the lock body, both of the contacts 18 and 20 will be opened, while the switch 24 will be closed and the alarm 23 will be actuated. This enables the user to determine prior to locking the padlock whether the battery is in an operable condition.

FIGS. 4 and 5 illustrate a modified form of the invention in which the shackle 2 includes an outer rigid metal sheath 35, and a bare electrically conductive wire 36 is located within the hollow sheath and spaced from the sheath by a series of spaced, insulted collars 37.

One end of the wire 36 extends through an insulated bushing 38 in the metal sheath 35 and is connected in the electrical circuit, as will be described hereinafter, while the opposite end 39 of the wire 36 terminates within the hollow sheath of the shackle 2.

As shown in FIG. 4, the end 40 of one of the shackle arms engages a spring plate 41 when the shackle is in the locked position and spring plate 41 carries a contact 42. The spring plate 41 will be urged upwardly when the shackle arm is withdrawn from the lock body, thereby uging the contact 42 into engagement with a contact 43 on the upper support plate 44.

Similarly, the opposite end 45 of the other shackle arm is adapted to engage a spring plate 46 when the shackle is in the locked position and spring plate 46 carries a contact 47. The force of the spring plate 46 will urge the contact 47 upwardly into engagement with a second contact 48, when the shackle is in the unlocked position, and the contact 48 is carried by a support plate 49. When the shackle is in the locked position within the lock body, the ends 40 and 45 of the shackle will force the contacts 42, 43 and 47, 48 out of engagement with each other.

An on-off switch 24, similar to that described with the first embodiment, is mounted on the tumbler mechanism 10 and the arm 25 of the switch is adapted to be engaged by the projection 26 on the lock bolt when the lock bolt is moved to the released position.

As in the case of the first embodiment, a provision is made to prevent the access plate 6 from being removed when the shackle is in the locked position. In this case, the shackle arms are provided with bends which define shoulders or ledges 50 which engage the upper surface of the plate 6 when the shackle is in the locked position.

The electrical circuit for the alarm system of FIGS. 4 is illustrated in FIG. 5. In this circuit the wire 36 of the shackle 2 is connected to the battery 22 via the line 51 and switch 24, while the sheath 35 of the shackle is connected to the junction of resistors 52 and 53 by lines 54 and 55.

One end of the insulated wire 27 of lock body 1 is connected to the battery through the line 51 and switch 24, and the lock body is connected to the junction of resistors 32 and 36 through lines 56 and 55.

Contact sets 42, 43 and 47, 48 are connected by lines 57 and 58, respectively, across the lines 51 and 55.

With the shackle 2 in the locked position, and the shackle not smashed or cut and the lock body not smashed or cut, the SCR 34 is held off by the connection of the gate lead to the negative side of the battery 22 via the resistor 52 and the lead wire 59. Any action that will momentarily connect the positive side of the battery 22 to the junction of resistors 52 and 53 will cause the SCR 34 to turn on. Turning on of the SCR will energize the alarm 23 and also energize the transistor 60 which will connect the positive side of battery 22 to the junction of resistor 52 and 53 via the transistor 60 and the resistor 53. This will supply adequate gate current to the SCR 34 so that it will remain on even if the original connection to the positive side of the battery to the junction of resistor 52 and 53 is open. The circuit arrangement of the alarm 23, SCR 34, resistors 52 and 53 and transistor 60 is such that the circuit latches in the alarm condition whenever the positive side of the battery is momentarily connected to the junction of resistors 52 and 53.

Smashing or crushing the shackle 2 will connect the positive side of the battery to the junction of resistors 52 and 53, since wire 36 is bare and the smashing will provide a connection between the wire 36 and the metal sheath 35. Cutting the shackle will at least make a momentary connection between the wire 36 and sheath 35 to similarly actuate the alarm circuit.

Cutting the lock body 1 will at least make a momentary connection between the wire 27 and lock body 1, as the cutting blade cuts through the lock body, to also connect the positive side of the battery to the junction of resistors 52 and 53 to actuate the alarm.

Forcing the shackle arms out of the lock body will cause the contact sets 42, 43 or 47, 48 to close and this action will also connect the positive side of the battery to the junctions of resistors 52 and 53 to again actuate the alarm.

The circuit shown in FIG. 5 will not draw any current from the battery unless the system is violated. Cutting or smashing the shackle, or cutting or smashing the lock body will operate to actuate the alarm system. Similarly, forcing either of the shackle arms out of the lock body will also actuate the alarm.

While the above description has shown the lock device in the form of a padlock, in which one end of the shackle is permanently connected to the lock body, it is contemplated that other types of locking devices can be used in which one or both of the shackle arms can be withdrawn from the lock body.

Various types of alarms or signals can be used in place of the horn, such as lights, radio frequency transmitter, smoke ejection, liquid ejection, or the like.

Similarly, it is contemplated that a mechanical system, such as wind-up spring, can be employed to operate an alarm instead of the electrically powered circuit.

Various modes of carrying out the invention are contemplated as being within the scope of the following claims particularly pointing out and distinctly claiming the subject matter which is regarded as the invention:

I claim:

1. A locking mechanism having an integral alarm system, including a lock body, shackle means having an end removably connected to the body, an electrically conductive element disposed within said shackle means, locking means disposed within the body and movable between a locked and released position, said locking means when in the locked position engaging the end of said shackle means to prevent removal of said end from the body and said locking means when in the released position permitting free removal of said end of the shackle means from said body, alarm means disposed within the body and connected in a normally non-conductive electrical circuit with said electrically conductive element and a source of electrical power, switch means connected in said circuit and having an open and a closed position, means responsive to moving the locking means to the released position for moving the switch means to the open position and reponsive to moving the locking means to the locked position for moving the switch means to the closed position, and means responsive to severing said element when said switch means is in the closed position for rendering said circuit conductive and actuating said alarm means.

2. The locking mechanism of claim 1, wherein said shackle means is a rigid shackle having an outer metal sheath, said element being insulated therefrom.

3. The locking mechanism of claim 1, wherein said alarm means is a horn.

4. The locking mechanism of claim 1, wherein said lock means is key actuated.

5. The locking mechanism of claim 1, and including means responsive to forceable removable of the shackle means from the lock body when the switch means is in the closed position for actuating said alarm means.

6. The locking mechanism of claim 1, and including a second electrically conductive element associated with the lock body and connected in said electrical circuit, severing of said second element by cutting the lock body when the switch means is in the closed position acting to render said circuit conductive to operate said alarm means.

7. A locking mechanism having an integral alarm system comprising a body, hollow electrically conductive shackle means having one end removably connected to the body, a first electrically conductive element disposed within the hollow interior of the shackle means and extending a substantial portion of the length of said shackle means, insulating means for spacing said element out of contact with said shackle means, a battery contained within the body, and alarm means disposed within the body, one end of said element connected in a normally non-conductive sensing circuit with the battery and the alarm means and said shackle means, the other end of said element being free of connection to said circuit, whereby the circuit is normally non-conductive, severing of said shackle means acting to bring said shackle means into electrical contact with said element to close said circuit and sound the alarm means.

8. The locking mechanism of claim 7, and including switch means connected in a second circuit with said battery and said alarm means and movable between an open and a closed position, connection of said shackle means to said body acting to move the switch means to the open position, and means operable as a consequence of forceable removal of the shackle means from the body for closing the switch means to actuate said alarm from the body for closing the switch means to actuate said alarm means.

9. The locking mechanism of claim 7, and including a second electrically conductive element disposed adjacent the inner surface of said body, second insulating means for spacing said second electrically conductive element out of contact with said body, one end of said second element being connected in a second electrical circuit with said battery and said alarm means and said body, the other end of said second element being free of connection with said second circuit whereby said second circuit is normally non-conductive, cutting of said lock body acting to move said second element into contact with said body to close said second circuit and sound said alarm means.

10. A locking mechanism having an integral alarm system, comprising a rigid electrically conductive structure, an electrically conductive element disposed adjacent said structure, insulating means for insulating the element from said structure, a battery, and alarm means, one end of said element being connected in a normally non-conductive sensing circuit with the battery and said alarm means and said structure, the other end of said element being free of connection to said circuit, whereby the circuit is normally non-conductive, deformation of said structure acting to move the structure into electrical contact with said element to close the circuit and sound said alarm means.

11. A locking mechanism having an integral alarm system, including a lock body, shackle means having an end removably connected to the body, an electrically conductive element disposed within the shackle means, locking means disposed within the body and movable between a locked and a released position, said locking means when in the locked position, engaging the end of said shackle means to prevent removal of said end from the body and said locking means when in the released position permiting free removal of said end of the shackle means from said body, alarm means disposed within the body, means responsive to severing said shackle means when the locking means is in the locked position for actuating said alarm means, a battery disposed within the body and connected to said alarm means, said body having an access opening for removal and insertion of said battery, a cover plate to enclose said access opening, and means associated with the shackle means for preventing removal of the cover plate when said end of the shackle means is engaged by said locking means.

12. The locking mechanism of claim 11, wherein said last named means comprises a projection on said shackle means and disposed to engage the outer surface of said cover plate.

* * * * *

UNITED STATES PATENT AND TRADEMARK OFFICE

CERTIFICATE OF CORRECTION

PATENT NO. : 3,993,987

DATED : November 23, 1976

INVENTOR(S) : EDWARD C. STEVENS

It is certified that error appears in the above-identified patent and that said Letters Patent are hereby corrected as shown below:

Column 1, Line 26, After "lock" insert ---body---, Column 3, Line 25, Cancel "insulting" and substitute therefor ---insulating---, Column 4, Line 31, Cancel "poWer" and substitute therefor ---power---, Column 4, Line 32, Cancel "batter" and substitute therefor ---battery---, Column 5, Line 10, Cancel "on-off" (without quotes) and substitute therefor ---"on-off"--- (with quotes), Column 5, Line 22 Cancel "Figs." and substitute therefor ---Fig.---, Column 6, Line 58, Cancel "removable" and substitute therefor ---removal---, Column 7, Lines 28 and 29, After "alarm" Cancel "from the body for closing the switch means to actuate said alarm".

Signed and Sealed this

Tenth Day of May 1977

[SEAL]

*Attest:*

RUTH C. MASON
*Attesting Officer*

C. MARSHALL DANN
*Commissioner of Patents and Trademarks*